US010017280B1

(12) United States Patent
Martin, Jr.

(10) Patent No.: US 10,017,280 B1
(45) Date of Patent: Jul. 10, 2018

(54) TOTE FOR SEPARATE ITEMS

(71) Applicant: Robert P. Martin, Jr., Camp Verde, AZ (US)

(72) Inventor: Robert P. Martin, Jr., Camp Verde, AZ (US)

( * ) Notice: Subject to any disclaimer, the term of this patent is extended or adjusted under 35 U.S.C. 154(b) by 0 days.

(21) Appl. No.: 15/683,836

(22) Filed: Aug. 23, 2017

(51) Int. Cl.
*B65D 25/22* (2006.01)
*B65B 5/06* (2006.01)
*B65B 5/10* (2006.01)
*B65D 21/02* (2006.01)

(52) U.S. Cl.
CPC ..... *B65B 5/068* (2013.01); *B65B 5/10* (2013.01); *B65D 21/0211* (2013.01)

(58) Field of Classification Search
CPC ..... B65B 5/068
USPC ..... 294/137, 152, 153, 156, 159, 165; 16/422, 426, 430
See application file for complete search history.

(56) References Cited

U.S. PATENT DOCUMENTS 254,849 A * 3/1882 Taylor
313,129 A * 3/1885 Tipney
345,435 A * 7/1886 Lefevre
1,173,506 A * 2/1916 Hall ..... A47G 23/06 206/777
1,976,206 A * 10/1934 Zellar ..... A01D 46/22 248/149
2,530,231 A * 11/1950 Detweiler ..... A47F 5/108 108/99
3,047,329 A * 7/1962 Gunderson, Jr. ..... B65D 7/40 232/43.1
3,966,103 A * 6/1976 Abrams ..... A47G 19/30 206/142
6,182,560 B1 * 2/2001 Andress ..... A47J 37/0718 126/25 R
8,662,548 B1 * 3/2014 Viani ..... A01B 1/02 15/257.1
2007/0154287 A1 * 7/2007 Lin ..... F16B 5/02 411/427
2011/0049922 A1 * 3/2011 Burrell ..... A45F 5/102 294/161

* cited by examiner

*Primary Examiner* — Paul T Chin
(74) *Attorney, Agent, or Firm* — Pearne & Gordon LLP

(57) ABSTRACT

A tote for collecting and transporting fragile items comprising a rectangular base, a handle fixed to the base, and a compartmentalized rectangular tray removably contained on the base, a perimeter of the base arranged to allow the tray to rest on a bottom of the base and to restrain the tray from sliding off the bottom, the handle being rigidly attached to the base and having an inverted U-shape that is sufficiently high and wide to allow several identical tray supporting items in individual compartments to be stacked on a bottom one of said trays.

2 Claims, 2 Drawing Sheets

TOTE FOR SEPARATE ITEMS

BACKGROUND OF THE INVENTION

The invention relates to improvements in hand-held basket-style totes useful for collecting and transporting small fragile articles.

PRIOR ART

Baskets have been used for ages for collecting and transporting small articles. Typically, prior art baskets or totes do not keep the articles segregated so that the articles can bump into one another in the carrier or basket, sometimes resulting in damage to an article. Fresh eggs from chickens or other fowl are examples of articles often carried in baskets and that are susceptible to damage when they are dropped or roll against one another in a basket. Other articles vulnerable to small impacts typically include ripe tomatoes and tree fruit.

There exists a need for a basket-like tote capable of maintaining articles deposited in it segregated from one another. The tote should be versatile, convenient to hold, position and carry, and be readily cleaned to the extent it is not self-cleaning.

SUMMARY OF THE INVENTION

The invention provides a tote carried with one hand and having a combined rigid frame and handle. The frame is provided with a base arranged to support a compartmentalized tray. The handle enables the tote to be confidently carried and, to the extent necessary, positively manipulated with the carrying hand. Ideally, the handle is configured to allow several trays to be stacked on the base and one another so that the tote can conveniently and safely carry dozens of separated articles.

In one embodiment, the tote is proportioned to receive a commercially available standardized 30 cell egg tray. The trays can be of a molded recycled paper (papier-mâché) type having a 5×6 cell matrix, for example. The frame is configured to surround a first tray so that the tray is restrained from accidentally falling off the tote in ordinary usage. The tote handle is proportioned to allow several egg filled trays to be stacked one upon the other. The trays and their contents are safely carried without risk of falling off the tote because of the ability of the trays to interlock with one another. The tote, ideally, has an open network bottom wall or base allowing it to self-clean.

DESCRIPTION OF THE PREFERRED EMBODIMENT

Figure 1:
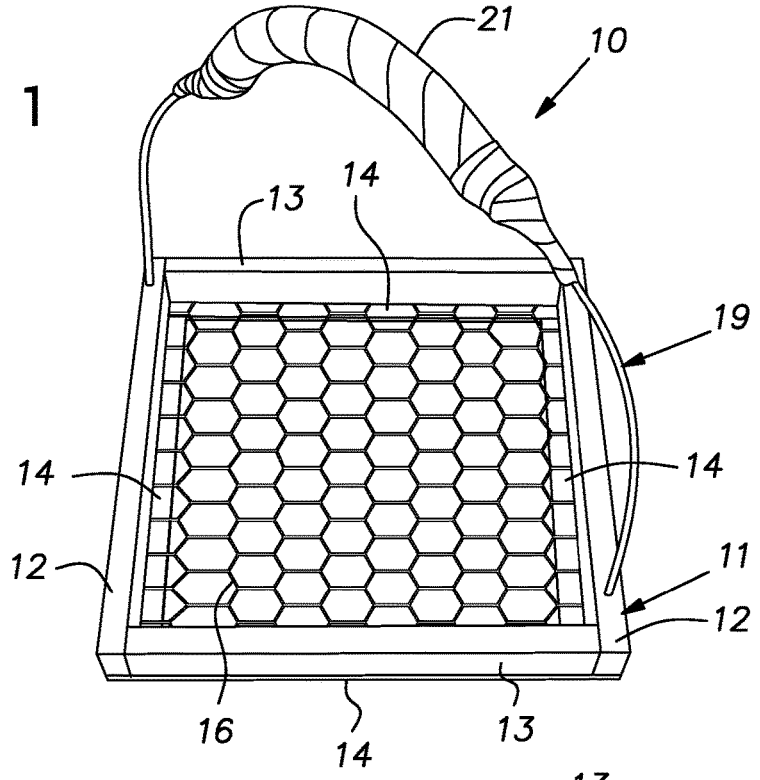
FIG. 1 is a perspective view of a tote constructed in accordance with the present invention.
Figure 2:
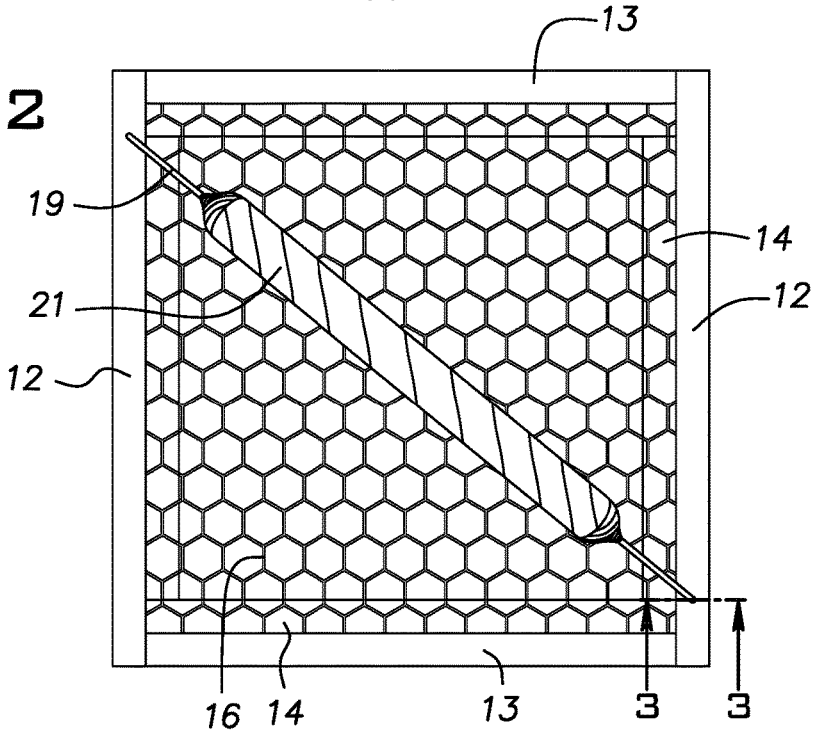
FIG. 2 is a plan view of the tote of FIG. 1.
Figure 3:
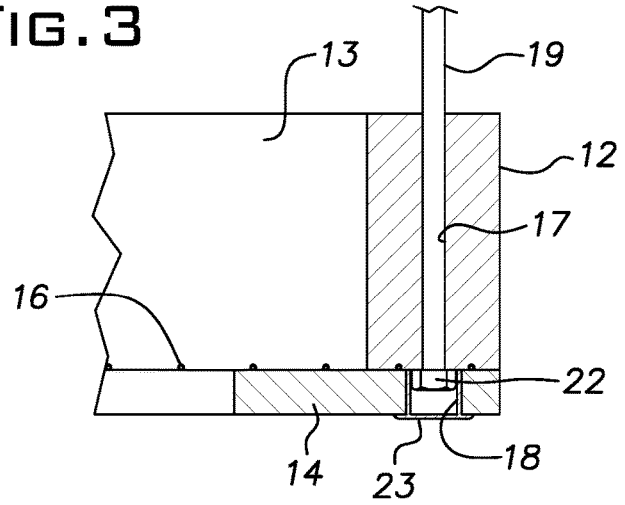
FIG. 3 is a fragmentary cross-sectional view of a portion of the tote taken in the plane 3-3 indicated in FIG. 2.

Referring particularly to FIGS. 1-3, a hand-carried tote 10 embodying the invention is illustrated. The illustrated tote 10 includes a flat or planar frame 11 constructed of wood. The frame 11 includes upper main pieces 12 and upper cross pieces 13 all of which can be ¾ inch by 1½ inch in cross-section. The pieces 12, 13 are fixed together with suitable nails, staples, screws, or dowels as well as glue, if desired. Lower wood strips 14 of the frame 11 can be ¼ inch by 1½ inch in cross-section. A planar bottom wall or base 16, in the present instance, is provided by conventional chicken wire with an open network sandwiched between the upper frame pieces 12, 13 and lower strips 14. The strips 14 are attached to the upper pieces 12, 13 along with the bottom wall 16 with staples, nails, or other fasteners and glue, if desired. In the illustrated case, the frame pieces 12, 13 are dimensioned to border or surround a rectangular area or pocket that is 12 inches square.

Holes 17 adjacent diagonally opposite corners of the frame 11 are drilled vertically through the main pieces 12 to the attached bottom strips 14. The bottom strips are drilled with counterbores 18 at the holes 17.

An inverted U-shaped handle 19 is constructed of a stiff essentially rigid wire and a central U-shaped hand grip 21. By way of example, the hand grip 21 can be a commercially available 45 degree pre-bent ½ inch rigid electrical plastic conduit el and the handle wire can be threaded through the conduit. The conduit handle can be wrapped with a suitable fabric and both the conduit and fabric can be taped at their ends to the wire.

Both ends of the handle wire can be threaded to receive a self-locking nut 22. The handle 19 is assembled to the frame 11 by inserting the threaded wire ends into the frame holes 17 to expose the threaded ends at the bottom of the frame and then by threading the nuts 22 onto the ends. The handle 19 is pulled to draw the nuts into the counterbores 18. The nuts 22 increase the effective size of the wire ends preventing the wire from being withdrawn from the holes 17. Preferably, the holes 17 are dimensioned to provide a clearance-free fit with the diameter of the wire so that the handle is essentially rigid with the frame 11 and remains upright. Molded plastic plugs 23 can be driven into the counterbores 18 to seal off the counterbores. The free state configuration of the handle wire can be arranged so that the wire ends are closer than the spacing of the holes 17 so that the handle is frictionally held in place in the holes.

A multi-cell or compartmentalized tray 26 such as commercially available for handling and storing eggs is used in combination with the tote frame 11. The compartmentalized tray illustrated in the figures is typically molded of recycled paper and has 30 3-dimensional cells or cavities arranged in a 5×6 rectangular matrix. The overall size of the tray 26 is 11¾ inch square so that it readily fits in the pocket surrounded by the frame 11. The depth of the pocket is more than one-half of the height of a tray.

Figure 4:
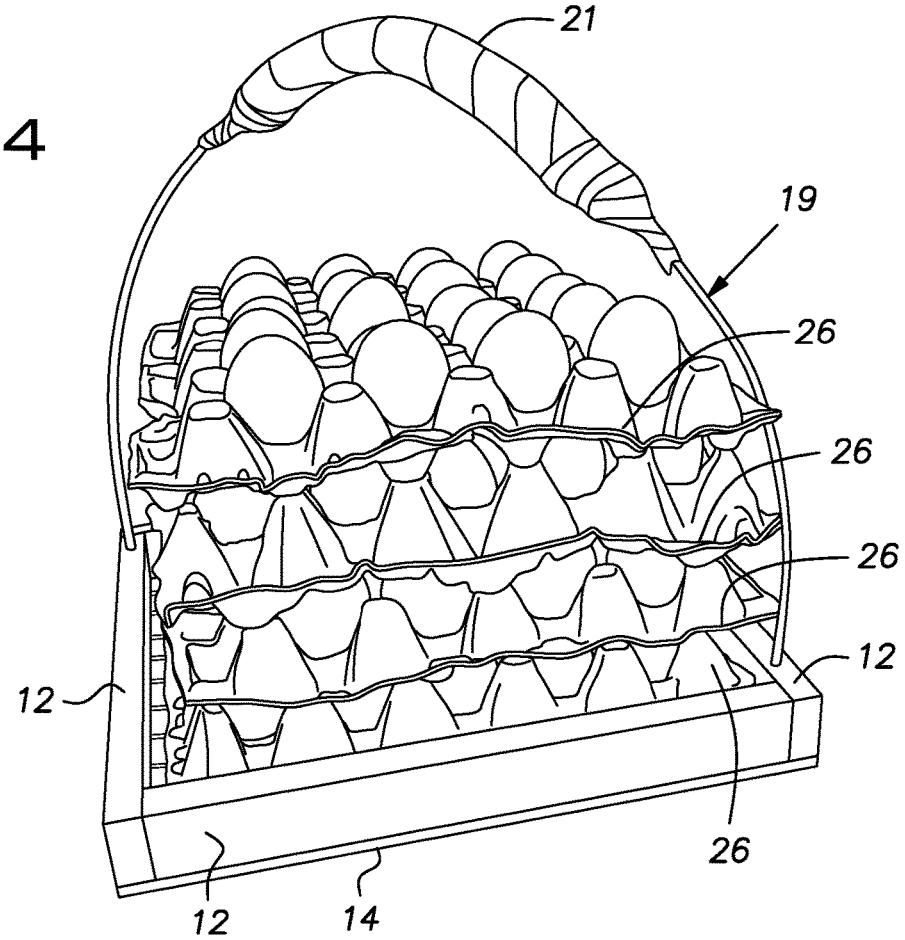
FIG. 4 is a perspective view of the tote and several stacked multi-cell trays carrying chicken eggs.

The tote 10 and tray 26 combined can be used, for example, to collect eggs in a coup or hen house. As shown in FIG. 4 multiple trays can be supported on the tote 10. The handle 19 has a deep U-section so that its sides lie outside a space taken up by several filled trays 26, e.g. as many as four or more, stacked in and above the pocket surrounded by the frame pieces 12 and 13. For reference, the handle wire lies outside the space above the rectangular frame pocket for a height at least one-half a minor plan dimension of the pocket.

The invention provides a lightweight, durable tote that is easy to carry and manipulate. The rigid handle and inverted U-shaped hand grip 21 resists unintentional pendulum-like swinging of the frame, as well as oscillations of the frame relative to the handle. The open network of the bottom wall provided by the chicken wire is essentially self-cleaning and, when necessary, it assists in scrubbing action by eliminating extended corner areas along the frame, where dirt and debris could otherwise accumulate and be difficult to remove.

The diagonal orientation of the vertical plane of the handle 19 and hand grip 21 is ergonometrically beneficial since a user's hand can be most comfortable at this orientation when the user's arm is lowered to his or her side. The diagonal arrangement also obtains the greatest clearance for the user's free arm to deposit articles on the tote.

The tote and suitable molded cell trays for maintaining items separate from one another can be used for items other than chicken eggs. For example, trays can be provided for duck, quail and/or pheasant eggs, as well as for tomatoes, apples, peaches, pears, especially when these vegetable and fruit items are picked when ripe. While the illustrated tote is square in plan view, the tote can be other rectangular shapes, it being understood that a square is a special case of a rectangular shape. For some purposes, it is contemplated that the described wooden frame can be replaced by a molded, extruded or cast plastic frame, or a metal frame.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A tote for collecting and transporting fragile items comprising a rectangular base, a handle fixed to the base, and a compartmentalized rectangular tray removably contained on the base, a perimeter of the base arranged to allow the tray to rest on a bottom of the base and to restrain the tray from sliding off the bottom, the bottom being an open network fixed to the base perimeter, the handle being rigidly attached to the base and having an inverted U-shape in a vertical plane that is sufficiently high and wide to allow several identical trays supporting items in individual compartments to be stacked on a bottom one of said trays, the handle including a hand grip constructed and arranged with vertical dimensions greater than horizontal dimensions measured transverse to a length of the hand grip enabling a person to control pendulum motion of the tote in a horizontal direction perpendicular to said plane.

2. A tote as set forth in claim 1, wherein lower ends of the handle are fixed adjacent diagonal corners of the base.

* * * * *